US008596376B2

(12) United States Patent
Holverson et al.

(10) Patent No.: US 8,596,376 B2
(45) Date of Patent: Dec. 3, 2013

(54) SUPPORT APPARATUS FOR SECURING A WING PLOW

(75) Inventors: Andrew Holverson, Mineral Point, WI (US); John Hromadka, Gratiot, WI (US)

(73) Assignee: Monroe Truck Equipment, Inc., Monroe, WI (US)

( * ) Notice: Subject to any disclaimer, the term of this patent is extended or adjusted under 35 U.S.C. 154(b) by 442 days.

(21) Appl. No.: 12/804,948

(22) Filed: Aug. 2, 2010

(65) Prior Publication Data

US 2012/0024551 A1 Feb. 2, 2012

(51) Int. Cl.
*E02F 3/76* (2006.01)

(52) U.S. Cl.
USPC ..... 172/811; 172/819

(58) Field of Classification Search
USPC ..... 172/786, 811, 819; 37/281
See application file for complete search history.

(56) References Cited

U.S. PATENT DOCUMENTS

| | | | | | |
|---|---|---|---|---|---|
| 2,193,532 | A * | 3/1940 | Frink | ..... | 37/234 |
| 3,125,818 | A * | 3/1964 | Kraft et al. | ..... | 37/236 |
| 3,429,380 | A * | 2/1969 | Launder et al. | ..... | 172/815 |
| 3,659,363 | A * | 5/1972 | Snyder | ..... | 37/231 |
| 4,096,652 | A * | 6/1978 | Raines et al. | ..... | 37/231 |
| 4,357,766 | A * | 11/1982 | Croteau et al. | ..... | 37/281 |
| 4,744,159 | A * | 5/1988 | Houle | ..... | 37/231 |
| 5,031,343 | A * | 7/1991 | Houle et al. | ..... | 37/231 |
| 5,177,887 | A * | 1/1993 | McGugan et al. | ..... | 37/236 |
| 6,249,992 | B1 * | 6/2001 | Irving et al. | ..... | 37/281 |
| 6,581,307 | B1 * | 6/2003 | Jones et al. | ..... | 37/281 |
| 7,954,262 | B2 * | 6/2011 | Bernier | ..... | 37/231 |

* cited by examiner

*Primary Examiner* — Thomas B Will
*Assistant Examiner* — Joel F. Mitchell
(74) *Attorney, Agent, or Firm* — Quarles & Brady LLP

(57) ABSTRACT

A support apparatus is disclosed for securing a material moving wing plow relative to a vehicle. The support apparatus includes a beam having a first and a second end, the beam being rigidly secured to the vehicle. A plate having a first and a second extremity is rigidly secured to the beam. A first trailing link is pivotally secured to the plate about a first pivotal axis. A second trailing link is pivotally secured to the plate about a second pivotal axis. A support arm is provided for supporting the wing plow. The support arm has a first termination and a second termination and is pivotally secured to the first trailing link about a third pivotal axis. Also, the support arm is pivotally secured to the second trailing link about a fourth pivotal axis. The first, second, third and fourth pivotal axes are spaced and parallel relative to each other so that when the vehicle moves in a forward direction, the third and fourth pivotal axes trail behind the first and second pivotal axes relative to the forward direction of the vehicle. The arrangement is such that during a plowing operation, the wing plow supported by the support arm moves smoothly over the material being moved so that a potentially dangerous diving of the wing plow into the material in a vicinity of the support arm is avoided.

14 Claims, 4 Drawing Sheets

SUPPORT APPARATUS FOR SECURING A WING PLOW

BACKGROUND OF THE INVENTION

1. Field of the Invention

The present invention relates to a support apparatus for securing a wing plow relative to a vehicle used for a wing plow application such as a truck, a loader or a grader.

More specifically, the present invention relates to a support apparatus for securing a material moving wing plow relative to a vehicle used for a wing plow application such as a truck, a loader or a grader.

2. Background Information

Wing plows are often used for removing snow from the hard shoulder of a highway. They are also used for smoothing limestone or other materials during a roadmaking or road repairing operation. The wing plow extends laterally from the side of a vehicle and includes a brace or braces for supporting the outboard end of the wing plow.

Various support arrangements have been proposed for supporting the inboard end of the wing plow. Such support arrangements usually include means for raising or lowering the wing plow because when the wing plow is not being used, the wing plow must be in a raised disposition when the truck or other vehicle is moving so that the wing plow is not in contact with the ground.

Many wing plow support arrangements employ pairs of parallel arms extending laterally outwards from the front nearside of a vehicle. The arrangement is such that in operation, the wing plow is permitted to rise and fall as it moves over the material being moved and with the bottom working edge of the wing plow remaining substantially parallel to the surface of the material.

However, with the aforementioned prior art wing plow support arrangements, there is a strong tendency for the working edge of the wing plow nearest to the vehicle to sink or dive into the material being moved. When this happens and the inboard end of the wing plow dives, the outboard end of the wing plow violently flies upwards and often causes damage to the side of the vehicle.

The present invention overcomes the aforementioned problem by providing a trailing link mechanism such that the inboard end and/or the outboard end of the wing plow is supported by a support arm which in turn is supported by trailing links rather than the prior art laterally extending links.

Consequently, by the provision of the trailing links according to the present invention, the inventors have found that in actual trials, the wing plow moves remarkably smoothly over various materials being moved and that such trailing links avoid the potentially dangerous problem caused by diving of the wing plow at the inboard end thereof.

Therefore, it is a primary feature of the present invention to provide a support apparatus for securing a material moving wing plow relative to a vehicle that overcomes the problems associated with prior art wing plow supports.

Another feature of the present invention is to provide a support apparatus for securing a material moving wing plow relative to a vehicle which avoids diving of the wing plow into material in the vicinity of the support apparatus.

Other features and advantages of the present invention will be readily apparent to those skilled in the art by a consideration of the detailed description of a preferred embodiment of the present invention contained herein.

SUMMARY OF THE INVENTION

The present invention relates to a support apparatus for securing a material moving wing plow relative to a vehicle.

The support apparatus includes a beam having a first and a second end, the beam being rigidly secured to the vehicle. The term vehicle used throughout the present invention includes a vehicle used for a wing plow application such as a truck, a loader or a grader or any other type of vehicle suitable for supporting and operating a wing plow. A plate having a first and a second extremity is rigidly secured to the beam. A first trailing link is pivotally secured to the plate about a first pivotal axis. A second trailing link is pivotally secured to the plate about a second pivotal axis. A support arm is provided for supporting the wing plow. The support arm has a first termination and a second termination and is pivotally secured to the first trailing link about a third pivotal axis. Also, the support arm is pivotally secured to the second trailing link about a fourth pivotal axis. The first, second, third and fourth pivotal axes are spaced and parallel relative to each other so that when the vehicle moves in a forward direction, the third and fourth pivotal axes trail behind the first and second pivotal axes relative to the forward direction of the vehicle. The arrangement is such that during a plowing operation, the wing plow supported by the support arm moves smoothly over the material being moved so that a potentially dangerous diving of the wing plow into the material in a vicinity of the support arm is avoided.

In a more specific embodiment of the present invention, an anchoring plate is secured to the first end of the beam for rigidly securing the beam to the vehicle.

Also, a further plate has a further first and a further second extremity. The further plate is rigidly secured to the beam between the plate and the first end of the beam.

A further first trailing link is pivotally secured to the further plate about the first pivotal axis.

Additionally, a further second trailing link is pivotally secured to the further plate about the second pivotal axis.

An arm has a further first termination and a further second termination. The arm is pivotally secured to the further first trailing link about the third pivotal axis. Also, the arm is pivotally secured to the further second trailing link about the fourth pivotal axis.

Moreover, a first ear extends from the beam, the first ear being disposed between the plate and the further plate.

Furthermore, a second ear extends from the beam, the second ear being disposed spaced and parallel relative to the first ear. The ears are disposed between the plate and the further plate.

A ram has a first and a second end, the first end of the ram being pivotally connected to the ears.

The ram is operably connected to a source of hydraulic pressure.

A first stud extends from the first trailing link, the first stud pivotally cooperating with the second end of the ram.

Also, a second stud extends from the further first trailing link, the second stud pivotally cooperating with the second end of the ram. The arrangement is such that, in operation, when the ram is actuated by the source of hydraulic pressure, the support arm and the arm are moved relative to the beam.

Additionally, the support arm and the arm remain substantially parallel to the plate and further plate when moved by the ram.

A first extension extends from the support arm adjacent to the first termination, the first extension defining a first hole.

Further, a second extension extends from the support arm adjacent to the second termination, the second extension defining a second hole.

A support pin extends through the first and second holes for locking and supporting the wing plow relative to the support arm.

Many modifications and variation in the present invention will be readily apparent to those skilled in the art by a consideration of the detailed description contained hereinafter taken in conjunction with the annexed drawings which show a preferred embodiment of the present invention. However, such modifications and variations fall within the spirit and scope of the present invention as defined by the appended claims. Included in such modifications would be the provision of a ram operably connected to a source of compresses air or any other type of ram such as an electrically operated ram or a mechanically operated lifting mechanism.

BRIEF DESCRIPTION OF THE DRAWINGS

Similar reference characters refer to the same parts throughout the various Figures of the drawings.

DETAILED DESCRIPTION OF THE DRAWINGS

Figure 1:
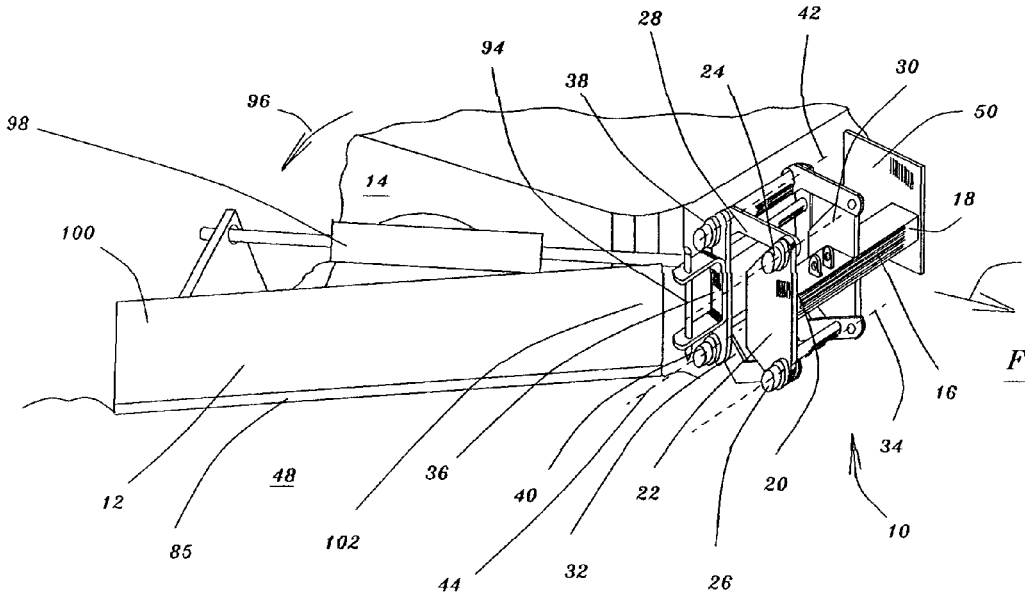
FIG. 1 is a perspective view of a support apparatus for securing a material moving wing plow relative to a vehicle according to the present invention.

FIG. 1 is a perspective view of a support apparatus generally designated 10 according to the present invention for securing a material moving wing plow 12 relative to a vehicle 14. As shown in FIG. 1, the support apparatus 10 includes a beam 16 having a first end 18 and a second end 20, the beam 16 being rigidly secured to the vehicle 14. A plate 22 having a first extremity 24 and a second extremity 26 is rigidly secured to the beam 16. A first trailing link 28 is pivotally secured to the plate 22 about a first pivotal axis 30. A second trailing link 32 is pivotally secured to the plate 22 about a second pivotal axis 34. A support arm 36 is provided for supporting the wing plow 12. The support arm 36 has a first termination 38 and a second termination 40 and is pivotally secured to the first trailing link 28 about a third pivotal axis 42. Also, the support arm 36 is pivotally secured to the second trailing link 32 about a fourth pivotal axis 44. The first, second, third and fourth pivotal axes 30, 34, 42 and 44 respectively are disposed spaced and parallel relative to each other so that when the vehicle 14 moves in a forward direction as indicated by the arrow 46, the third and fourth pivotal axes 42 and 44 respectively trail behind the first and second pivotal axes 30 and 34 respectively relative to the forward direction 46 of the vehicle 14. The arrangement is such that during a plowing operation, the wing plow 12 supported by the support arm 36 moves smoothly over the material 48 being moved so that a potentially dangerous diving of the wing plow 12 into the material 48 in a vicinity of the support arm 36 is avoided.

In a more specific embodiment of the present invention an anchoring plate 50 is secured to the first end 18 of the beam 16 for rigidly securing the beam 16 to the vehicle 14.

Figure 2:
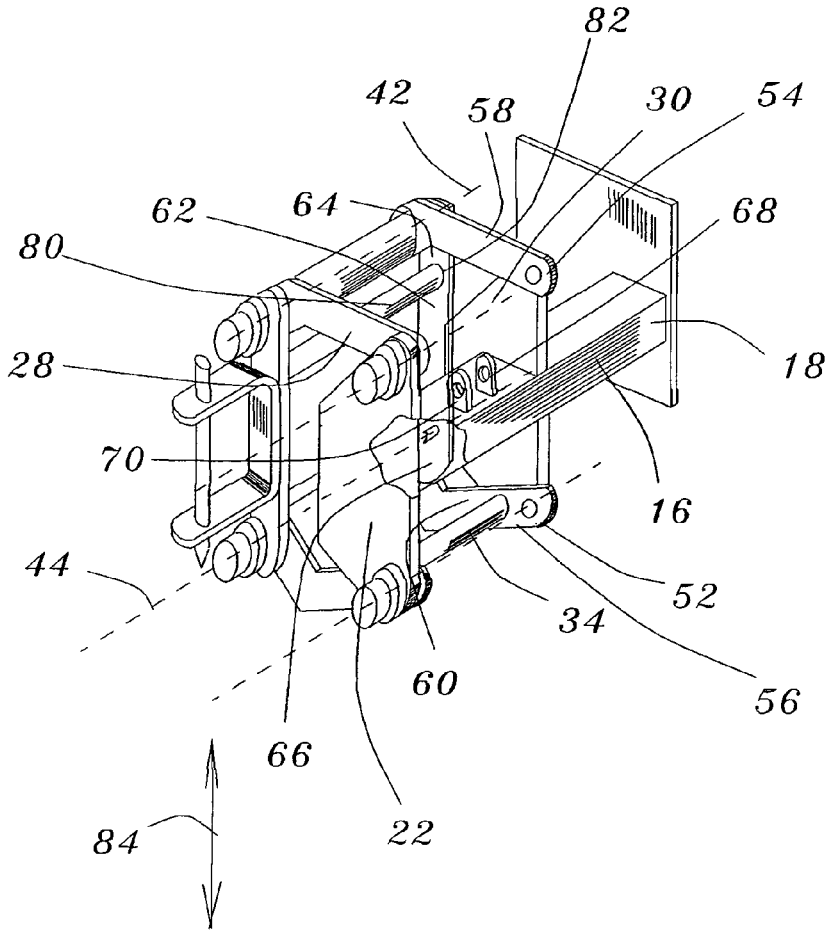
FIG. 2 is an enlarged view partially in section of the wing plow support apparatus shown in FIG. 1.

FIG. 2 is an enlarged view partially in section of the wing plow support apparatus 10 shown in FIG. 1. As shown in FIG. 2, a further plate 52 has a further first extremity 54 and a further second extremity 56. The further plate 52 is rigidly secured to the beam 16 between the plate 22 and the first end 18 of the beam 16.

A further first trailing link 58 is pivotally secured to the further plate 52 about the first pivotal axis 30.

Additionally, a further second trailing link 60 is pivotally secured to the further plate 52 about the second pivotal axis 34.

An arm 62 has a further first termination 64 and a further second termination 66. The arm 62 is pivotally secured to the further first trailing link 58 about the third pivotal axis 42. Also, the arm 62 is pivotally secured to the further second trailing link 60 about the fourth pivotal axis 44.

Moreover, a first ear 68 extends from the beam 16, the first ear 68 being disposed between the plate 22 and the further plate 52.

Furthermore, a second ear 70 extends from the beam 16, the second ear 70 being disposed spaced and parallel to the first ear 68, the ear 70 being disposed between the plate 22 and the further plate 52.

Figure 3:
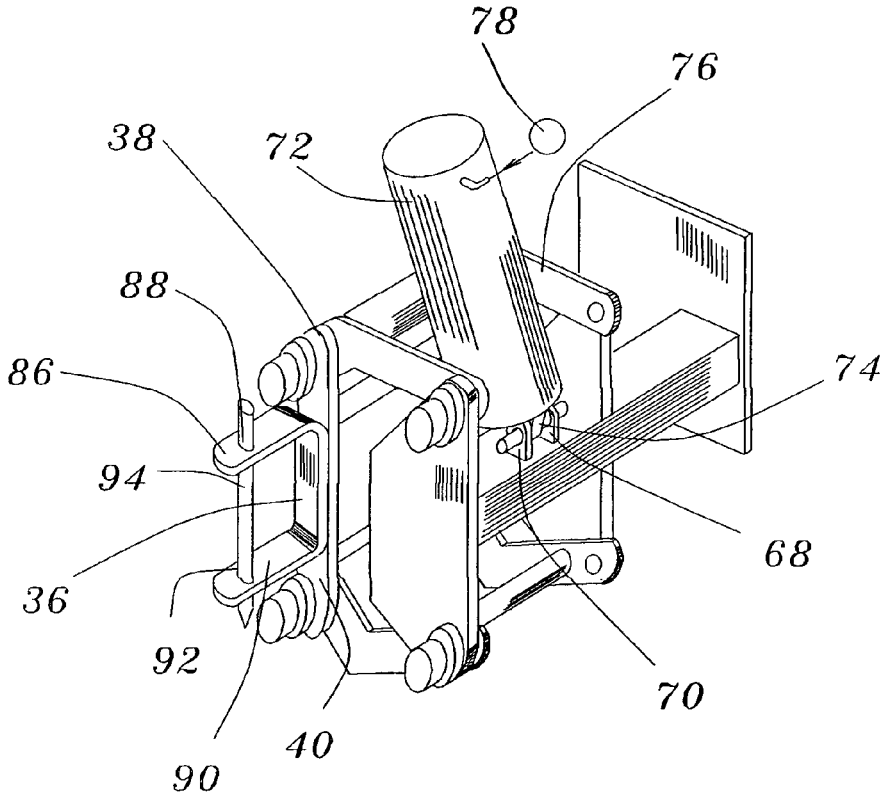
FIG. 3 is a similar view to that shown in FIG. 2 but shows the location of the ram.

FIG. 3 is a similar view to that shown in FIG. 2. However, FIG. 2 shows for clarity, an actuating ram removed therefrom. As shown in FIG. 3, a ram 72 has a first and a second end 74 and 76 respectively, the first end 74 of the ram 72 being pivotally connected to the ears 68 and 70.

The ram 72 is operably connected to a source of hydraulic pressure 78.

As shown in FIG. 2, a first stud 80 extends from the first trailing link 28, the first stud 80 pivotally cooperating with the second end 76 of the ram 72 as shown in FIG. 3.

Also, as shown in FIG. 2, a second stud 82 extends from the further first trailing link 58, the second stud 82 pivotally cooperating with the second end 76 of the ram 72. The arrangement is such that, in operation, when the ram 72 is actuated by the source of hydraulic pressure 78, the support arm 36 and the arm 62 are moved as indicated by the arrow 84 relative to the beam 16.

Additionally, the support arm 36 and the arm 62 remain substantially parallel to the plate 22 and the further plate 52 when moved as shown by arrow 84 by the ram 72 and by reaction of the working edge 85 of the wing plow 12 with the material 48 as shown in FIG. 1.

As shown in FIG. 3, a first extension 86 extends from the support arm 36 adjacent to the first termination 38, the first extension 86 defining a first hole 88.

Further, a second extension 90 extends from the support arm 36 adjacent to the second termination 40, the second extension 90 defining a second hole 92.

A support pin 94 extends through the first and second holes 88 and 92 respectively for locking and supporting the wing plow 12 relative to the support arm 36.

In operation of the support apparatus 10, the anchoring plate 50 is rigidly secured to the front of the vehicle 14. When the wing plow 12 is moved laterally outwardly as indicated by the arrow 96 shown in FIG. 1, away from the vehicle 14 by a hydraulic cylinder 98 extending between the first termination 38 of the support arm 36 and an outboard end 100 of the wing plow 12, the support apparatus 10 supports the wing plow 12 and is attached to the inboard end 102 of the wing plow 12 by the removable support pin 94. When the ram 72 is controllably released from the source of hydraulic pressure 78, the wing plow 12 lowers under gravity until the working edge 85 of the wing plow 12 contacts the material 48 to be moved. When forward movement of the vehicle 14 as indicated by the arrow 46 causes the working edge 85 of the wing plow 12 to engage the material 48, such material 48 is moved. However, if the working edge 85 of the wing plow 12 encounters unusual resistance from the material 48, the trailing links 28, 32, 58 and 60 permit the wing plow 12 to smoothly rise and ride over such unusual resistance in the material 48 rather than permitting the inboard end 102 of the wing plow 12 to dig into or dive into such material 48 which often occurs when the prior art laterally extending links are employed.

Figure 4:
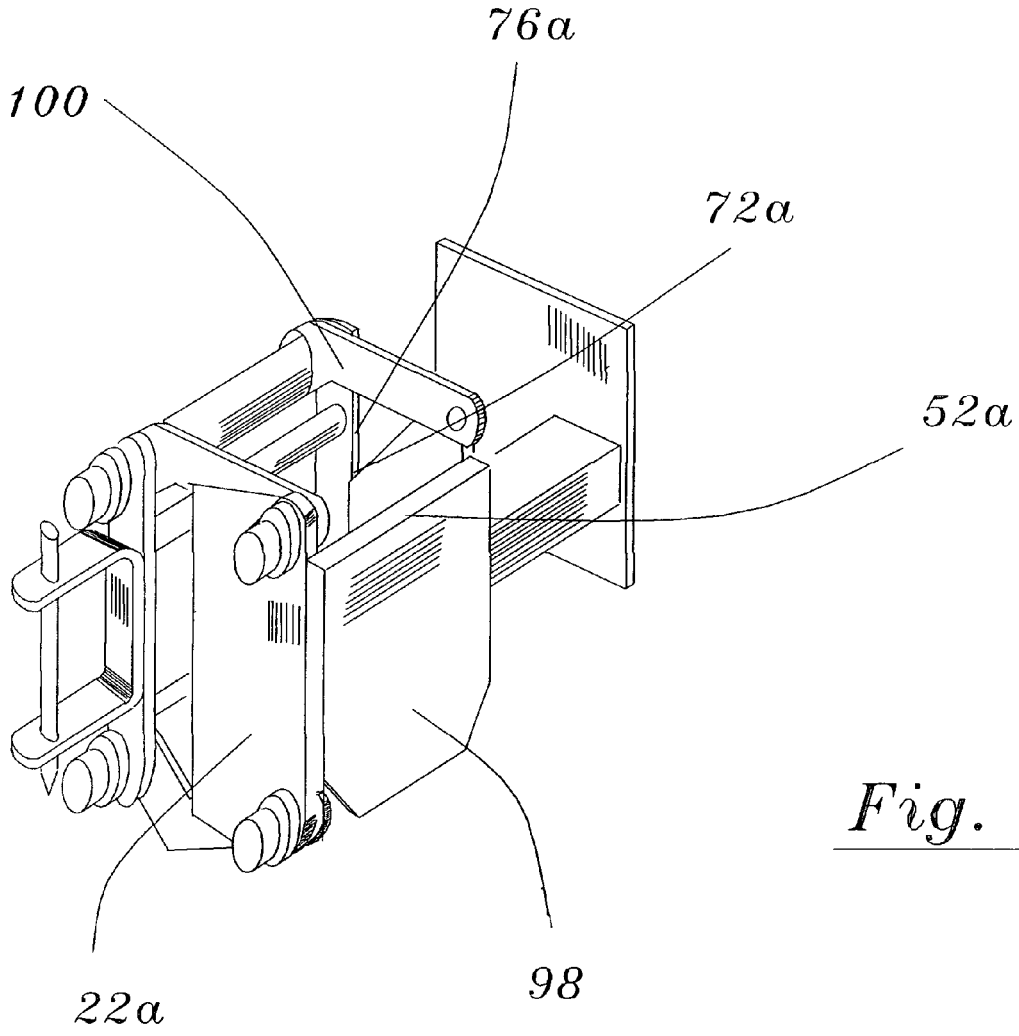
FIG. 4 is a perspective view of a further embodiment of the present invention.

FIG. 4 is a perspective view of a further embodiment of the present invention. As shown in FIG. 4, the plate and further plate 22*a* and 52*a* respectively are of trapezoidal configuration. Also, the plates 22*a* and 52*a* are joined together by a cover 98.

Additionally, the second end 76*a* of the ram 72*a* is pivotally connected to a strap 100 extending between the plates 22*a* and 52*a*.

Therefore, the present invention provides a unique wing plow support arrangement in which the wing plow moves smoothly over the material being removed while avoiding the danger of having the wing plow dive into the material at the inboard end of the wing plow.

What is claimed is:

1. A support apparatus for securing a material moving wing plow relative to a vehicle, said support apparatus comprising:

a beam having a first and a second end, said beam being rigidly secured to the vehicle;

a plate having a first and a second extremity, said plate being rigidly secured to said beam;

a first trailing link pivotally secured to said plate about a first pivotal axis;

a second trailing link pivotally secured to said plate about a second pivotal axis;

a support arm for supporting the wing plow, said support arm having a first termination and a second termination, said support arm being pivotally secured to said first trailing link about a third pivotal axis, said support arm being secured to said second trailing link so that during a plowing operation, the wing plow supported by said support arm moves smoothly over the material being moved so that a potentially dangerous diving of the wing plow into the material in a vicinity of said support arm is avoided;

said support arm being pivotally secured to said second trailing link;

said support arm being pivotally secured to said second trailing link about a fourth pivotal axis, said first, second, third and fourth pivotal axes being spaced and parallel relative to each other so that when the vehicle moves in a forward direction, said third and fourth pivotal axes trail behind said first and second pivotal axes relative to said forward direction of the vehicle;

a further plate having a further first and a further second extremity, said further plate being rigidly secured to said beam between said plate and said first end of said beam;

a further first trailing link pivotally secured to said further plate about said first pivotal axis;

a further second trailing link pivotally secured to said further plate about said second pivotal axis; and an arm having a further first termination and a further second termination, said arm being pivotally secured to said further first trailing link about said third pivotal axis, said arm being pivotally secured to said further second trailing link about said fourth pivotal axis.

2. A support apparatus as set forth in claim 1 further including:

a first ear extending from said beam, said ear being disposed between said plate and said further plate;

a second ear extending from said beam, said ear being disposed spaced and parallel to said first ear and disposed between said plate and said further plate.

3. A support apparatus as set forth in claim 2 further including:

a ram having a first and a second end, said first end of said ram being pivotally connected to said ears.

4. A support apparatus as set forth in claim 3 wherein said ram is operably connected to a source of hydraulic pressure.

5. A support apparatus as set forth in claim 4 further including:

a first stud extending from said first trailing link, said first stud pivotally cooperating with said second end of said ram;

a second stud extending from said further first trailing link, said second stud pivotally cooperating with said second end of said ram such that, in operation, when said ram is actuated by said source of hydraulic pressure, said support arm and said arm are moved relative to said beam.

6. A support apparatus as set forth in claim 5 wherein said support arm and said arm remain substantially parallel to said plate and further plate when moved by said ram.

7. A support apparatus for securing a material moving wing plow relative to a vehicle, said support apparatus comprising:

a beam having a first and a second end, said beam being rigidly secured to the vehicle;

a plate having a first and a second extremity, said plate being rigidly secured to said beam;

a first trailing link pivotally secured to said plate about a first pivotal axis;

a second trailing link pivotally secured to said plate about a second pivotal axis;

a further plate having a further first and a further second extremity, said further plate being rigidly secured to said beam between said plate and said first end of said beam;

a further first trailing link pivotally secured to said further plate about said first pivotal axis;

a further second trailing link pivotally secured to said further plate about said second pivotal axis; and an arm having a further first termination and a further second termination, said arm being pivotally secured to said further first trailing link about a third pivotal axis, said arm being secured to said further second trailing link so that during a plowing operation, the wing plow supported by a support arm which is movably supported by said first and second trailing links and said further first and second trailing links, moves smoothly over the material being moved so that a potentially dangerous diving of the wing plow into the material in a vicinity of said support arm is avoided.

8. A support apparatus for securing a material moving wing plow relative to a vehicle, said support apparatus comprising:

a beam having a first and a second end, said beam being rigidly secured to the vehicle;

a plate having a first and a second extremity, said plate being rigidly secured to said beam;

a first trailing link pivotally secured to said plate about a first pivotal axis;

a second trailing link pivotally secured to said plate about a second pivotal axis;

a support arm for supporting the wing plow, said support arm having a first termination and a second termination, said support arm being pivotally secured to said first trailing link about a third pivotal axis, said support arm being secured to said second trailing link so that during a plowing operation, the wing plow supported by said support arm moves smoothly over the material being moved so that a potentially dangerous diving of the wing plow into the material in a vicinity of said support arm is avoided;

an anchoring plate secured to said first end of said beam for rigidly securing said beam to the vehicle;

a further plate having a further first and a further second extremity, said further plate being rigidly secured to said beam between said plate and said first end of said beam;

a further first trailing link pivotally secured to said further plate about said first pivotal axis;

a further second trailing link pivotally secured to said further plate about said second pivotal axis;

an arm having a further first termination and a further second termination, said arm being pivotally secured to said further first trailing link about said third pivotal axis, said arm being secured to said further second trailing link;

a first ear extending from said beam, said ear being disposed between said plate and said further plate;

a second ear extending from said beam, said ear being disposed spaced and parallel to said first ear and disposed between said plate and said further plate;

a ram having a first and a second end, said first end of said ram being pivotally connected to said ears;

said ram being operably connected to a source of hydraulic pressure;

a first stud extending from said first trailing link, said first stud pivotally cooperating with said second end of said ram;

a second stud extending from said further first trailing link, said second stud pivotally cooperating with said second end of said ram such that, in operation, when said ram is actuated by said source of hydraulic pressure, said support arm and said arm are moved relative to said beam;

said support arm and said arm remain substantially parallel to said plate and further plate when moved by said ram;

a first extension extending from said support arm adjacent to said first termination, said first extension defining a first hole;

a second extension extending from said support arm adjacent to said second termination, said second extension defining a second hole; and a support pin extending through said first and second holes for locking and supporting the wing plow relative to said support arm.

9. A support apparatus for securing a material moving wing plow relative to a vehicle, said support apparatus comprising:

a beam having a first and a second end, said beam being rigidly secured to the vehicle;

a plate having a first and a second extremity, said plate being rigidly secured to said beam;

a first trailing link pivotally secured to said plate about a first pivotal axis;

a second trailing link pivotally secured to said plate about a second pivotal axis;

a support arm for supporting the wing plow, said support arm having a first termination and a second termination, said support arm being pivotally secured to said first trailing link about a third pivotal axis, said support arm being secured to said second trailing link so that during a plowing operation, said first and second trailing links trail away from said plate in a direction which is opposite to a direction of movement of the vehicle such that the wing plow supported by said support arm moves smoothly over the material being moved so that a potentially dangerous diving of the wing plow into the material in a vicinity of said support arm is avoided;

a further plate having a further first and a further second extremity, said further plate being rigidly secured to said beam between said plate and said first end of said beam;

a further first trailing link pivotally secured to said further plate about said first pivotal axis;

a further second trailing link pivotally secured to said further plate about said second pivotal axis;

an arm having a further first termination and a further second termination, said arm being pivotally secured to said further first trailing link about said third pivotal axis, said arm being pivotally secured to said further second trailing link about a fourth pivotal axis.

10. A support apparatus as set forth in claim 9 further including:

a first ear extending from said beam, said ear being disposed between said plate and said further plate;

a second ear extending from said beam, said ear being disposed spaced and parallel to said first ear and disposed between said plate and said further plate.

11. A support apparatus as set forth in claim 10 further including:

a ram having a first and a second end, said first end of said ram being pivotally connected to said ears.

12. A support apparatus as set forth in claim 11 wherein said ram is operably connected to a source of hydraulic pressure.

13. A support apparatus as set forth in claim 12 further including:

a first stud extending from said first trailing link, said first stud pivotally cooperating with said second end of said ram;

a second stud extending from said further first trailing link, said second stud pivotally cooperating with said second end of said ram such that, in operation, when said ram is actuated by said source of hydraulic pressure, said support arm and said arm are moved relative to said beam.

14. A support apparatus as set forth in claim 13 wherein said support arm and said arm remain substantially parallel to said plate and further plate when moved by said ram.

* * * * *